US009704378B2

(12) United States Patent
Won

(10) Patent No.: US 9,704,378 B2
(45) Date of Patent: Jul. 11, 2017

(54) RESCUER LOCATOR USING BIDIRECTIONAL SIGNAL TRANSMITTER

(71) Applicant: Jong Man Won, Jeju-do (KR)

(72) Inventor: Jong Man Won, Jeju-do (KR)

( * ) Notice: Subject to any disclaimer, the term of this patent is extended or adjusted under 35 U.S.C. 154(b) by 0 days.

(21) Appl. No.: 14/768,732

(22) PCT Filed: Jun. 10, 2015

(86) PCT No.: PCT/KR2015/005805
§ 371 (c)(1),
(2) Date: Aug. 18, 2015

(87) PCT Pub. No.: WO2015/190819
PCT Pub. Date: Dec. 17, 2015

(65) Prior Publication Data

US 2017/0092110 A1 Mar. 30, 2017

(30) Foreign Application Priority Data

Jun. 11, 2014 (KR) ..... 10-2014-0071124

(51) Int. Cl.

| | |
|---|---|
| ***G08B 1/08*** | (2006.01) |
| ***G08B 25/01*** | (2006.01) |
| ***G08B 7/06*** | (2006.01) |
| ***G08B 21/04*** | (2006.01) |
| ***G08B 25/10*** | (2006.01) |

(52) U.S. Cl.
CPC ..... *G08B 25/016* (2013.01); *G08B 7/06* (2013.01); *G08B 21/0415* (2013.01); *G08B 25/10* (2013.01)

(58) Field of Classification Search
CPC ..... G08B 27/001; G08B 25/14; G08B 7/066; G08B 13/19645; G08B 13/19682; G08B 13/19695; G08B 21/02; G08B 25/00; G08B 17/06; G08B 21/10; G08B 25/005; G08B 25/014; G08B 25/08; G08B 29/04
USPC ..... 340/539.1, 539.13, 572.1–572.9, 539.18, 340/538.15, 539.26, 545.3, 568.1, 573.4
See application file for complete search history.

(56) References Cited

U.S. PATENT DOCUMENTS

2007/0202927 A1* 8/2007 Pfleging ..... G08B 27/001 455/567
2008/0042844 A1* 2/2008 Christopher ..... A62B 99/00 340/572.4

(Continued)

FOREIGN PATENT DOCUMENTS

KR 1019970019157 4/1997

*Primary Examiner* — Daniel Previl
(74) *Attorney, Agent, or Firm* — IPLA P.A.; James E. Bame

(57) ABSTRACT

A rescuer locator using a bidirectional signal transmitter wherein each rescuer who is dispatched to a disaster spot so as instantly recognize a dangerous state of other rescuers who had been dispatched for rescue or fire suppression, carries a signal transmitter which may be taken by another rescuer when in emergency and may be configured to ask help in such a way to transmit an emergency signal to a base unit installed at a control vehicle, and the signal transmitter equips with a motion detection sensor so as to automatically transmit signals to the base unit depending on the movements of a rescuer who is dispatched to a disaster spot, thus checking in real time a dangerous state of each rescuer.

1 Claim, 4 Drawing Sheets

(56) References Cited

U.S. PATENT DOCUMENTS

| | | | | |
|---|---|---|---|---|
| 2012/0286952 | A1* | 11/2012 | Cienfuegos | G08B 5/002<br>340/539.13 |
| 2015/0077282 | A1* | 3/2015 | Mohamadi | G01S 7/415<br>342/27 |
| 2015/0195681 | A1* | 7/2015 | Flynn | H04W 4/22<br>455/404.2 |

* cited by examiner

RESCUER LOCATOR USING BIDIRECTIONAL SIGNAL TRANSMITTER

BACKGROUND

The present invention relates to a rescuer locator using a bidirectional signal transmitter, and in particular to a rescuer locator using a bidirectional signal transmitter wherein each rescuer who is dispatched to a disaster spot so as instantly recognize a dangerous state of other rescuers who had been dispatched for rescue or fire suppression, carries a signal transmitter which may be taken by another rescuer when in emergency and may be configured to ask help in such a way to transmit an emergency signal to a base unit installed at a control vehicle, and the signal transmitter equips with a motion detection sensor so as to automatically transmit signals to the base unit depending on the movements of a rescuer who is dispatched to a disaster spot, thus checking in real time a dangerous state of each rescuer.

In general, rescuers are exposed to various emergency situations during rescue or fire suppression. The rescuers who are dispatched to a disaster spot frequently die in accident. For this reason, various technologies are disclosed so as to minimize any damages of rescuers in such a way to instantly locate the rescuers who are in danger. More specifically, in the Korean patent application number 10-1995-0032375, a wireless pager system with a rescue signal unit includes a temperature sensor unit which is connected to an input side of a system micro processor and is configured to detect the temperature of a human body; a structure function selection key for selecting a structure function; an alarm signal generation unit which is connected to an output unit of a micro processor and is configured to generate an alarm signal of an exclusive frequency along with a conventional pager sound generation unit, an output switching unit for selectively supplying the outputs from the pager sound generation unit and the alarm signal generation unit to a speaker; and a high frequency crystal (over tens of MHz) which generates an exclusive frequency. Since the indoor temperature at a disaster spot has effect on a rescuer's body temperature. It is impossible to determine an emergency situation of a rescuer by measuring the rescuer's body temperature. For this reason, a rescuer who is dispatched to a disaster spot carries a safety device having a motion detection sensor. If there is not any motion for a predetermined time in a rescuer, an alarm sound outputs from the safety device, so that other rescuers can search and rescue the rescuer who is in danger. If it is not an emergency situation or a rescuer does work which has less motion for a predetermined time or takes rest, an alarm sound may output, thus causing inconvenience. Time setting is not available. In case of emergency situation, if any rescuer is not present near the rescuer who is in danger, an alarm sound may not be heard, so other rescuers or commander may not recognize such emergency situation, which means that there is a limit to securing a safety for the sake of rescuers. The above safety device does not have any communication means for manually informing an emergency situation to a control station or other rescuers.

SUMMARY OF THE INVENTION

Accordingly, it is an object of the present invention to provide a rescuer locator using a bidirectional signal transmitter wherein it is formed of a signal transmitter having a signal transmission and reception module for communications, and if there is not any motion in a rescuer, a danger signal can be automatically transmitted to a base unit using a motion detection sensor and a timer of a signal transmitter, thus outputting an alarm sound, whereupon it is possible to secure safety of a rescuer who is in danger.

It is another object of the present invention to provide a rescuer locator using a bidirectional signal transmitter which may allow to output an alarm sound by recognizing any motion of a rescuer so as to rescue a rescuer who may be in danger by tracing the position of a rescuer who is in danger.

It is further another object of the present invention to provide a rescuer locator using a bidirectional signal transmitter which allows to confirm a position distribution of each rescuer which is dispatched to a disaster spot.

To achieve the above objects, there is provided a rescuer locator using a bidirectional signal transmitter which may include, but is not limited to, a signal transmitter and a base unit, wherein the base unit configured to operate using a battery may include, but is not limited to, a display unit, a center button unit, a direction key unit, a sound output unit, a light emitting unit, a vibration module, a chip set and a signal transmission and reception module; and the signal transmitter configured to operate using a battery may include, but is not limited to, a sound output unit, a center button unit, a chip set, a light emitting unit, a vibration module, a signal transmission and reception module, a motion detection sensor and a timer. Each rescuer carrying a signal transmitter formed of a timer and a motion detection sensor is dispatched to a disaster spot. If there is not any motion in a rescuer who has been dispatched to a disaster spot, for a predetermined time, a danger signal is automatically transmitted from a signal transmission and reception module to a base unit through a chip set provided at the signal transmission and reception unit. The above danger signal is transmitted to the signal transmission and reception module of the base unit, thus operating the light emitting unit, the sound output unit, the vibration module or the display unit and the sound output unit, light emitting unit and vibration module of the signal transmitter, so that other rescuers carrying the base unit or a command on a control vehicle having the base unit can easily recognize such a danger situation of a corresponding rescuer who has been dispatched to a disaster spot.

In addition, the present invention may include a signal transmitter with a signal transmission and reception module and a base unit for a wireless communication. A danger signal may be called to the base unit or the signal transmitter, thus operating the sound output unit, light emitting unit and vibration module of the base unit or the signal transmitter so as to search a rescuer. When a rescue is not necessary or a rescue is completed, the rescuer locator of the present invention may be stopped.

In a rescuer locator using a bidirectional signal transmitter of the present invention, any motion of a rescuer who has been dispatched to a disaster spot may be detected using a motion detection sensor. If there is not any motion in the rescuer for a predetermine time, a timer is operated so as to first transmit a danger signal to the signal transmitter disposed at the base unit. a rescuer who carries the display unit, the sound output unit, the light emitting unit or the vibration unit which are controlled by the chip set of the base unit, and the sound output unit, the light emitting unit or the vibration module of the signal transmitter operating at the same time as the base unit or a commander who can confirm the base unit installed on a vehicle can stop the operations of the display unit, the sound output unit or the vibration module of the base unit or the signal transmitter using the center button. Thereafter, if there is not any motion in a corresponding rescuer who has been dispatched to a disaster spot, the signal transmitter second transmits a danger signal to the base unit. A rescuer who carries a base unit can search and rescue a rescuer who is in danger, by operating the sound output unit, the light emitting unit or the vibration unit of the base unit and the signal transmitter.

In a rescuer locator using a bidirectional signal transmitter of the present invention, each rescuer carrying a signal transmitter having an identification number by rescuer is dispatched to a disaster spot, and if a danger signal is transmitted using a display unit disposed at the base unit, a corresponding identification number flickers or is displayed, so it is possible to recognize the identification of a rescuer who is in danger and trace and rescue through a position trace of a bearer of a signal transmitter.

In a rescuer locator using a bidirectional signal transmitter of the present invention, since the signal transmitter equips with an RFID tag. In a fire space wherein an RFID locator is installed, it is possible to display a position distribution of rescuers in a disaster area on a base unit using an RFID tag signal of the signal transmitter of each rescuer and an RFID signal reader disposed at the base unit.

Since the rescuer locator using a bidirectional signal transmitter of the present invention is formed of a signal transmitter having a signal transmission and reception module, and a base unit, wireless communication is available, and a danger signal can be transmitted to the base unit or the signal transmitter, thus operating a sound output unit, a light emitting unit and a vibration module disposed at each base unit or signal transmitter, whereby it is possible to rescue a rescuer who is in danger. If a rescue work is not necessary or a rescue is completed, the operations of the system may be stopped.

If a rescuer who is in danger at a disaster spot cannot move for a predetermined time, the motion detection sensor of the signal transmitter detects such situation and first transmits an emergency signal to the base unit and allows to operate the light emitting unit, the vibration module or the sound output unit provided at the base unit or the signal transmitter. Another rescuer carrying the base unit or a commander who can confirm the base unit installed at a vehicle can recognize the dangerous situation of the rescuer who has been dispatched to the disaster spot. A rescuer having a base unit can inform another rescuer having the signal transmitter of a danger situation using a radio set, thus allowing a quick rescue. If safety is secured by checking any motion of the rescuer who has a signal transmitter, the rescuer having the base unit presses the center button disposed at the base unit, thus first stopping the operation of the sound output unit of the base unit.

After the operation of the base unit is stopped using the center button, if a continuous motion is not detected in the rescuer who carries a corresponding signal transmitter, a danger signal is second transmitted from the corresponding signal transmitter to the base unit, thus recognizing the position of the rescuer carrying the corresponding signal transmitter by concurrently operating the sound output unit disposed at the base unit and the signal transmitter and rescuing the rescuer who is in danger.

In addition, the present invention allows to minimize error operation of device and battery consumption which may occur due to unnecessary signal transmission, in such a way to activate or inactivate the operation of the motion detection sensor based on situations.

In addition, since the signal transmitter equips with an RFID function with which a position can be traced, so the position distribution of the rescuers can be displayed on the base unit at a disaster spot, and it is possible to quickly confirm the position of the rescuer. To this end, the rescuer who is in emergency can be instantly rescued.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

Figure 1:
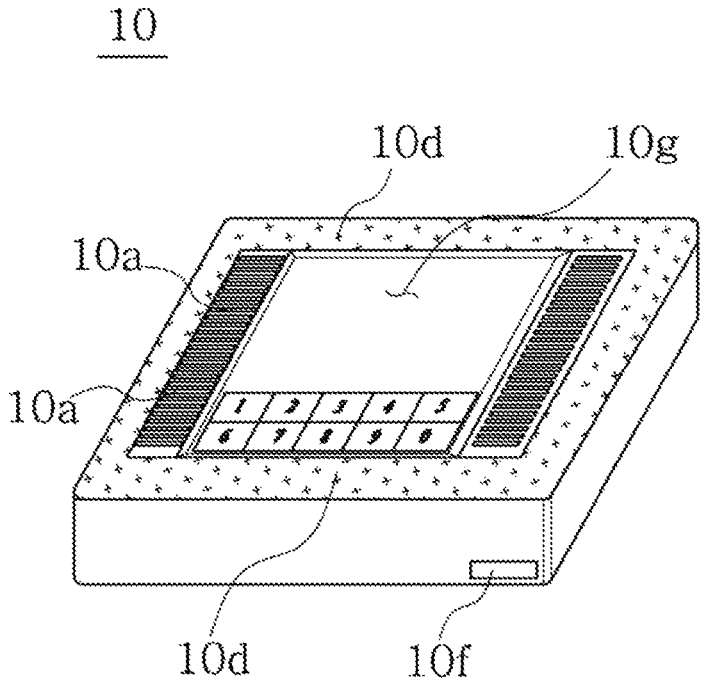
FIGS. 1 and 2 are views illustrating exteriors of a base unit of a rescuer locator using a bidirectional signal transmitter according to the present invention.
Figure 2:
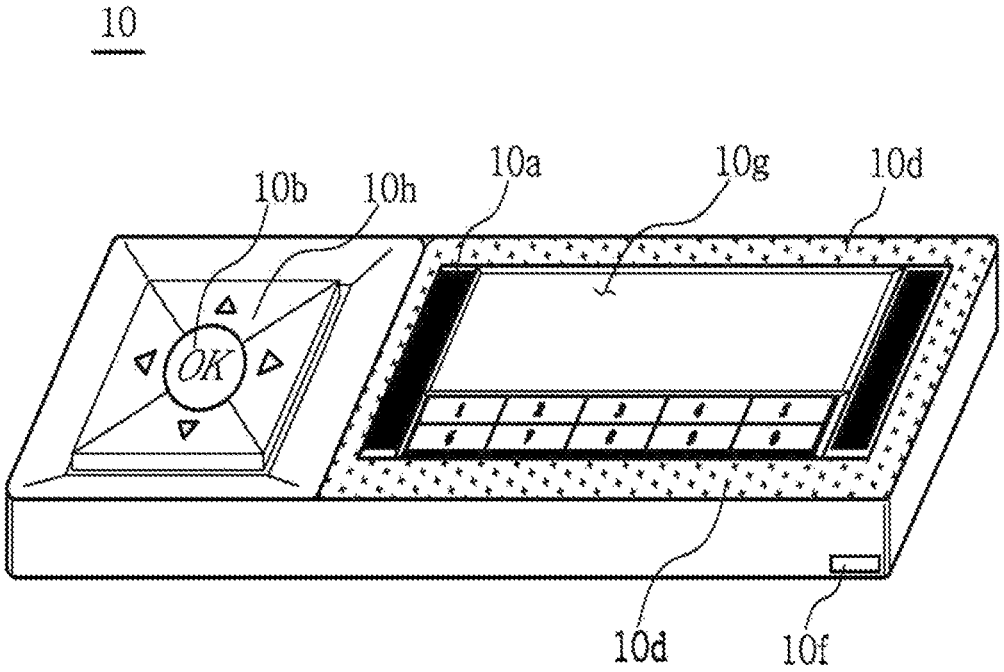
Figure 3:
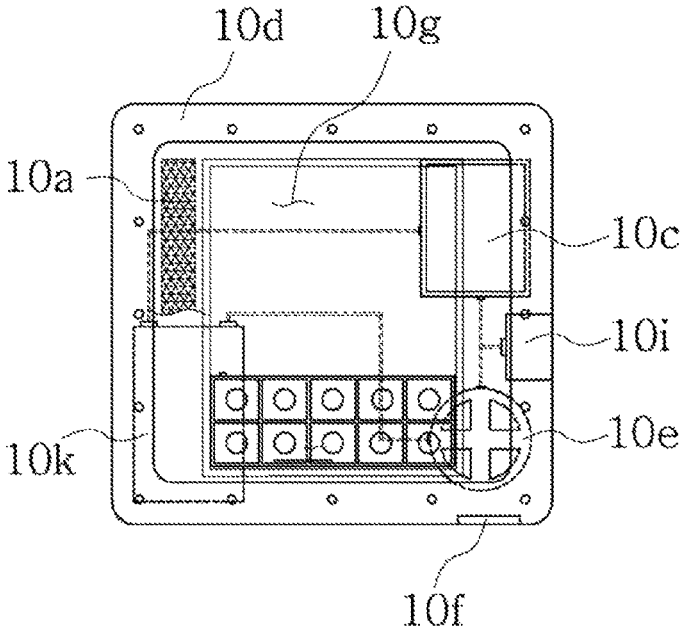
FIGS. 3 and 4 are views illustrating an interior of a base unit of a rescuer locator using a bidirectional signal transmitter according to the present invention.
Figure 4:
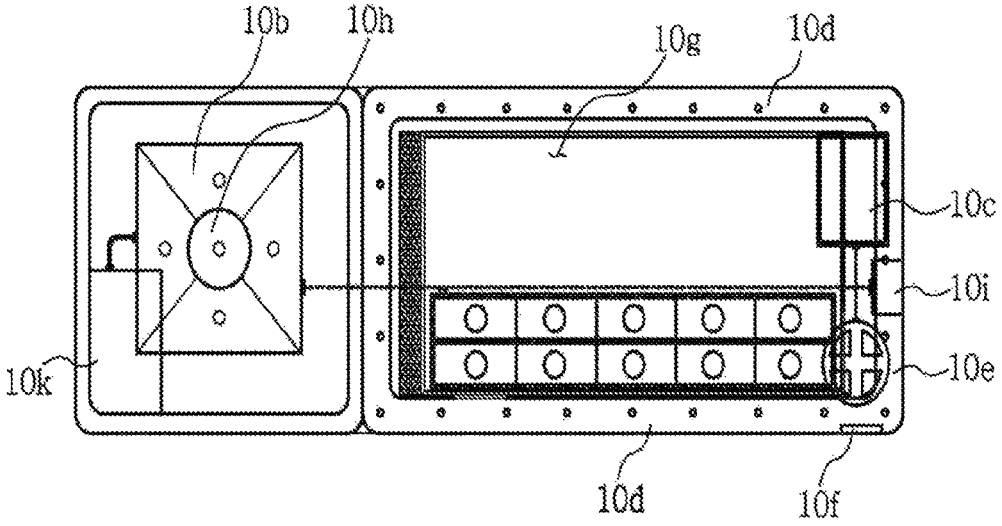
Figure 5:
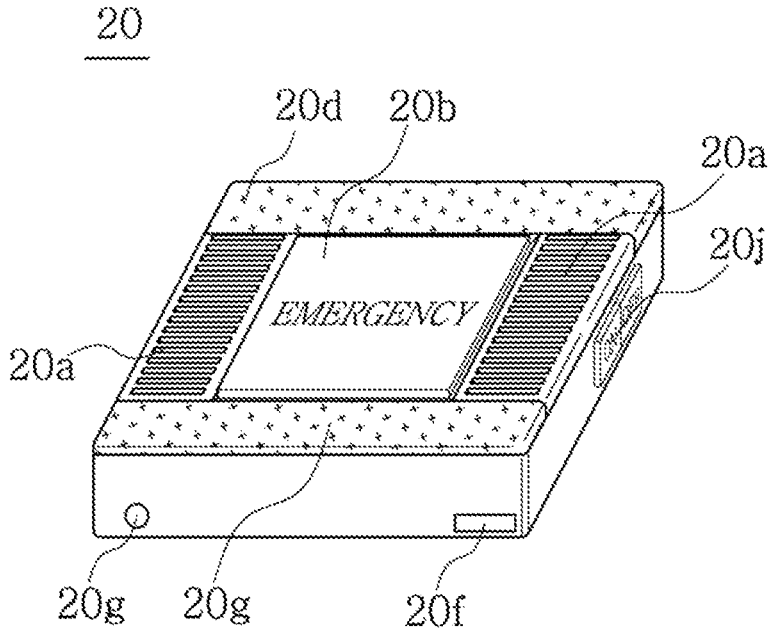
FIG. 5 is a view illustrating an exterior of a signal transmitter of a rescuer locator using a bidirectional signal transmitter according to the present invention.
Figure 6:
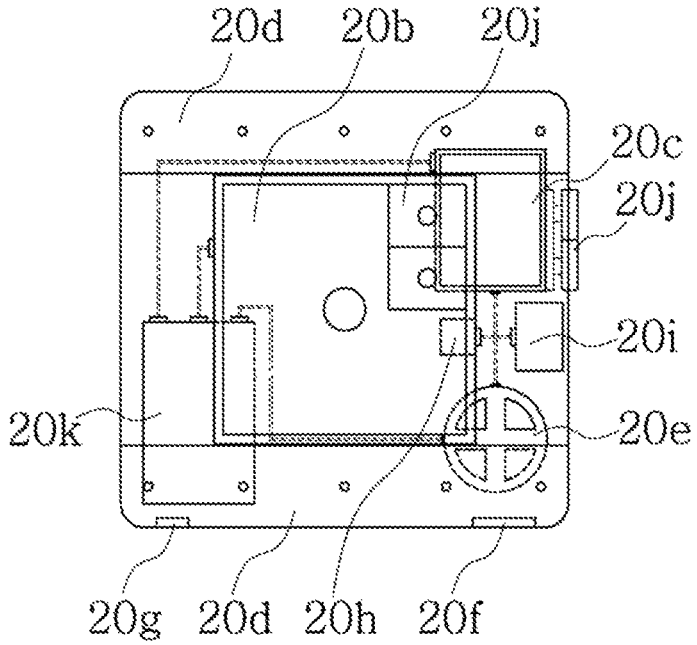
FIG. 6 is a view illustrating an interior of a signal transmitter of a rescuer locator using a bidirectional signal transmitter according to the present invention.
Figure 7:
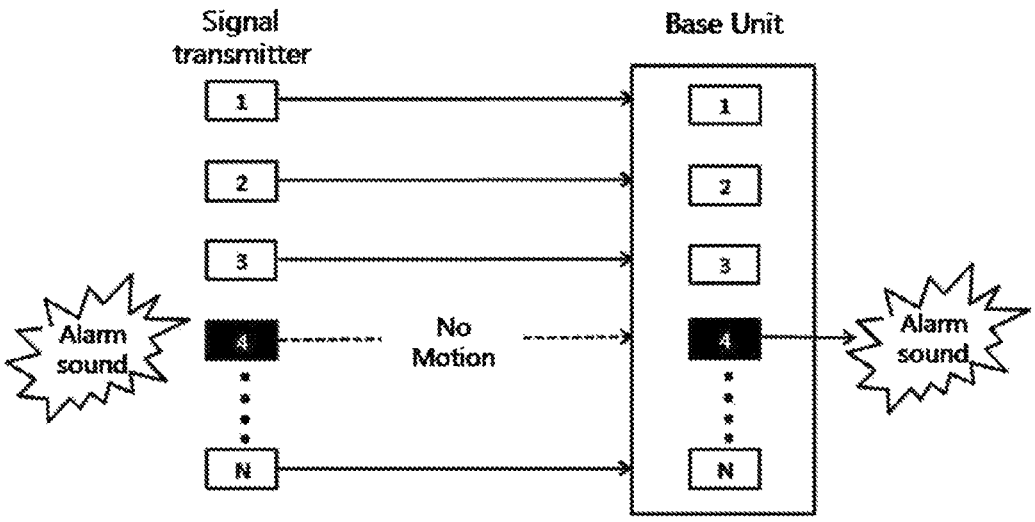
FIG. 7 is a view for describing an embodiment of a base unit of a rescuer locator using a bidirectional signal transmitter according to the present invention.

The present invention will be described in detail with reference to the accompanying drawings.

The present invention is directed to a rescuer locator using a bidirectional signal transmitter which is driven by a battery may include, but is not limited to, a signal transmitter 20 that a rescuer carries when entering a disaster spot, and a base unit 10 which is configured to receive signals from the signal transmitter 20, thus allowing to search the position of a rescuer who is in danger.

More specifically, the signal transmitter 20 operating by a battery may include, but is not limited to, a sound output unit 20*a*, a center button unit 20*b*, a chip set 20*c*, a light emitting unit 20*d*, a vibration module 20*e*, a signal transmission and reception module 20*f*, a motion detection sensor 20*g*, a timer 20*h*, and an RFID tag 20*i*. The base unit 10 operating by a battery may include, but is not limited to, a display unit 10*g*, a center button unit 10*b*, a direction key unit 10*h*, a sound output unit 10*a*, a light emitting unit 10*d*, a vibration module 10*e*, a chip set 10*c*, a signal transmission and reception module 10*f* and an RFID reader 10*i*.

In the present invention, wireless communication is available using the signal transmitter and the signal transmission and reception module 10*f* of the base unit 10. Each signal transmitter 20 can be selectively called using the center button unit 10*b* and the direction key unit 10*h* of the base unit 10. The sound output unit 10*a*, 20*a*, the light emitting unit 10*d*, 20*d*, and the vibration module 10*e*, 20*e* of the base unit 10 or the signal transmitter 20 can be operated in such a way to transmit a danger signal to the base unit 10 by using the center button unit 20*b* of the signal transmitter 20, so a rescuer who is in danger may be rescued or when a rescue is completed, the operations can be stopped.

The rescuer which has been dispatched to a disaster spot carries the signal transmitter 20 which operates by a battery and equips with the timer 20*h* and the motion detection sensor 20*g*. If there is not any motion in the rescuer who has been dispatched to a disaster spot, a danger signal can be automatically transmitted from the signal transmission and reception module 20*f* of the signal transmitter 20 to the base unit 10 through the chip set 20*c* disposed at the signal transmitter 20. The danger signal is transferred to the signal transmission and reception module 20*f* disposed at the base unit 10, thus operating the light emitting unit 10*d*, the sound output unit 10*a*, the vibration module 10*e* or the display unit 10*g* which are operated by the chip set 10*c*, so another rescuer carrying the base unit 10 can recognize that a corresponding rescuer who has been dispatched to a disaster spot is in danger. The light emitting unit 20*d*, the sound output unit 20*a* and the vibration module 20*e* of the signal transmitter 20 are configured to operate concurrently with the base unit 10, thus enhancing efficiency in searching the rescuer who is in danger. More specifically, the motion detection sensor 20*g* can detect any motion in the rescuer who has been dispatched to a disaster spot. If there is not any motion in the rescuer for a predetermined time through the motion detection sensor 20*g* using the timer 20*h*, a danger signal transmission command is transferred to the signal transmission and reception module 20*f* of the signal transmitter 20, and a danger signal is first transmitted to the signal transmission and reception module 10*f* disposed at the base unit 10 through the signal transmission and reception module 20*f*, thus operating the display unit 10*g*, the sound output unit 10*a*, the light emitting unit 10*d* or the vibration module 10*e* which are controlled by the chip set 10*c* of the base unit 10. The rescuer carrying the base unit 10 and the commander who can confirm the base unit installed in the vehicle can rescue the rescuer in danger. If rescue is completed or if rescue is not necessary, the rescuer or the command can stop the operation of the display unit 10*g*, the sound output unit 10*a*, the light emitting unit 10*d* or the vibration modulator 10*e* of the base unit 10 or the operation of the light emitting unit 20*d*, the sound output unit 20*a* and the vibration module 20*e* of the signal transmitter 20 which operates concurrently with the base unit. If there is not any motion in a rescuer for a predetermined time, who has been dispatched to a disaster spot, the signal transmitter second transmits a danger signal to the base unit 10, thus operating the sound output unit 10*a*, 20*a*, the light emitting unit 10*d*, 20*d* or the vibration module 10*e*, 20*e* of the base unit 10 and the signal transmitter 20, so the rescuer carrying the base unit 10 can search and rescue the rescuer who is in danger. Namely, if there is not any motion in a rescuer carrying a signal transmitter for a predetermined time interval set using the timer of the signal transmitter, a danger signal can be automatically transmitted to the base unit. At the same time, the signal transmitter may be configured to operate the light emitting unit, the vibration module and the sound output unit.

In the present invention, each rescuer is dispatched to a disaster spot carrying a signal transmitter 20 with an identification number by rescuer, and when a danger signal of the signal transmitter 20 is transmitted using the display unit 10*g* disposed at the base unit 10, a corresponding identification number may flick or may be displayed, so it is possible to recognize the identification of the rescuer who is in danger, and the rescuer can be rescued by tracing the position of the bearer of the signal transmitter In addition, the present invention allows to minimize error operation of the system and battery consumption, which may occur during signal transmission, in such a way to activate or inactivate the operations of such a component using a motion detection sensor button 20*j* disposed at the signal transmitter 20 based on status of work site and situation.

In the present invention, the wireless signal for data communication between the signal transmitter 20 and the base unit 10 may be various wireless signals, for example, very high frequency, ultra very high frequency, high frequency, infrared ray, FM frequency (RF), bluetooth, RFID or WiFi. An exclusive signal intensifying device may be used so as to intensify wireless signal at a disaster site, the example of which will be described because such a device is known.

In addition, an RFID locator may be further installed, if necessary, so as to display on the base unit the position distribution of the rescuers who are dispatched to a disaster site using the RFID tag 20*i* disposed at the signal transmitter. Each RFID locator allows to recognize the position of a corresponding rescuer based on the intensity of the signal of the RFID tag 20*i* of the signal transmitter that each rescuer carries. The RFID reader 10*i* of the base unit allows to receive the position distribution of each signal transmitter in the form of data and display on the display unit 10*g*, thus monitoring in real time the position of the rescuer.

In addition, the operation of the sound output unit 20*a* of the signal transmitter 20 can be controlled by selecting an identification number of the signal transmitter that the rescuer who has been dispatched to a disaster spot, carries using the direction key disposed at the base unit of the present invention.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

LEGEND OF REFERENCE NUMBER

| | |
|---|---|
| 10: Base unit | 10a: Base sound output unit |
| 10b: Base center button unit | 10c: Base chip set |
| 10d: Base light emitting unit | 10e: Base vibration module |
| 10f: Base signal transmission and reception module | |
| 10g: Display unit | 10h: Direction key unit |
| 10i: RFID reader | 10k: Base battery unit |
| 20: Signal transmitter | |
| 20a: Sound output unit of signal transmitter | |
| 20b: Center button unit of signal transmitter | |
| 20c: Chip set of signal transmitter | |
| 20d: Light emitting unit of signal transmitter | |
| 20e: Vibration module of signal transmitter | |
| 20f: Signal transmission and reception module of signal transmitter | |
| 20g: Motion detection sensor | 20h: Timer |
| 20i: RFID tag | |
| 20k: Battery unit of signal transmitter | |
| 20j: Motion detection sensor button | |

What is claimed is:

1. A rescuer locator using a bidirectional signal transmitter, comprising:

a signal transmitter which includes at least one among a light emitting unit, a sound output unit and a vibration module, and a center button unit, a chip set, a signal transmission and reception module, a motion detection sensor and a timer and operates by a battery;

a base unit which includes at least one among a display unit, a center button unit, a direction key unit, a sound output unit, a light emitting unit and a vibration module, and a chip set, and a signal transmission and reception module and operates by a battery; and an RFID tag and an RFID reader configured to display the position distribution of rescuers on the display unit of the base unit, in which the signal transmitter and the base unit operate with an RFID provided at a disaster spot, wherein a danger signal is wirelessly transmitted using a signal transmission and reception module and a center button unit disposed at the signal transmitter and the base unit, operating a sound output unit, a light emitting unit and a vibration module provided at the base unit or the signal transmitter, and in the signal transmitter, if there is not any motion for a predetermined time in a rescuer who has been dispatched to a disaster spot, a danger signal is first transmitted automatically from the signal transmission and reception module to the base unit at a time interval set by a chip set disposed at the signal transmitter, operating the display unit, the sound output unit, the light emitting unit or the vibration module provided at the base unit, and if any motion is not detected in a corresponding rescuer, the sound output unit, the light emitting unit or the vibration module of the base unit and the signal transmitter are second operated, searching the rescuer.

* * * * *